US009379429B2

(12) United States Patent
Liu et al.

(10) Patent No.: US 9,379,429 B2
(45) Date of Patent: Jun. 28, 2016

(54) ANTENNA ASSEMBLY AND WIRELESS COMMUNICATION DEVICE USING THE SAME

(71) Applicant: FIH (Hong Kong) Limited, Kowloon (HK)

(72) Inventors: Chi-Sheng Liu, New Taipei (TW); Chih-Yang Tsai, New Taipei (TW); Chuan-Chou Chi, New Taipei (TW); Hao-Ying Chang, New Taipei (TW); Chao-Wei Ho, New Taipei (TW); Pai-Cheng Huang, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 208 days.

(21) Appl. No.: 14/296,629

(22) Filed: Jun. 5, 2014

(65) Prior Publication Data

US 2014/0361930 A1 Dec. 11, 2014

(30) Foreign Application Priority Data

Jun. 7, 2013 (TW) ..... 102120249 A

(51) Int. Cl.

| | |
|---|---|
| ***H01Q 1/24*** | (2006.01) |
| ***H01Q 9/42*** | (2006.01) |
| ***H01Q 5/378*** | (2015.01) |

(52) U.S. Cl.
CPC ..... *H01Q 1/243* (2013.01); *H01Q 5/378* (2015.01); *H01Q 9/42* (2013.01)

(58) Field of Classification Search
CPC ..... H01Q 1/243; H01Q 9/04; H01Q 9/42
USPC ..... 343/700 MS, 702, 829, 846
See application file for complete search history.

(56) References Cited

U.S. PATENT DOCUMENTS

| | | | | | |
|---|---|---|---|---|---|
| 5,467,097 | A * | 11/1995 | Toko | H01Q 1/244 | 343/702 |
| 7,639,187 | B2 * | 12/2009 | Caballero | H01Q 1/088 | 343/702 |
| 8,228,239 | B2 * | 7/2012 | Lagnado | G06F 1/1616 | 343/702 |
| 8,325,095 | B2 * | 12/2012 | Nishikido | H01Q 1/243 | 343/700 MS |
| 8,742,997 | B2 * | 6/2014 | Nickel | G01R 31/2822 | 343/700 R |

* cited by examiner

*Primary Examiner* — Tho G Phan
(74) *Attorney, Agent, or Firm* — ScienBiziP, P.C.

(57) ABSTRACT

An antenna assembly includes a first antenna, a second antenna, and at least one connecting member. The first antenna includes a radiator and at least one connecting portion connected to the radiator, and the radiator is a part of a housing of a wireless communication device. The at least one connecting member is connected to the at least one connecting portion to fix the first antenna to the wireless communication device to feed current to the first antenna and the second antenna.

10 Claims, 3 Drawing Sheets

ANTENNA ASSEMBLY AND WIRELESS COMMUNICATION DEVICE USING THE SAME

FIELD

The disclosure generally relates to antenna assemblies, and particularly, to an antenna assembly for receiving/transmitting multiband wireless signals, and a wireless communication device using the same.

BACKGROUND

Antennas are used in wireless communication devices such as mobile phones. Wireless communication devices use multiband antennas to receive/transmit wireless signals at different frequencies.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
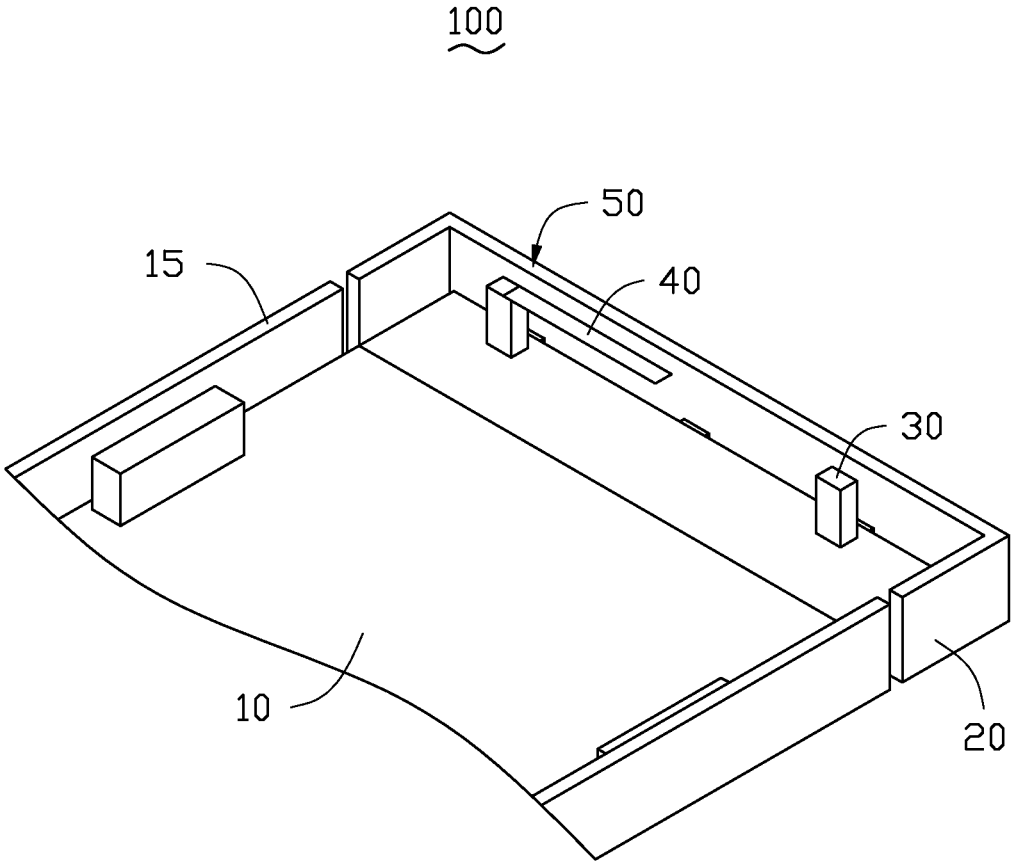
FIG. 1 is a schematic, assembly view of a wireless communication device employing an antenna assembly.
Figure 2:
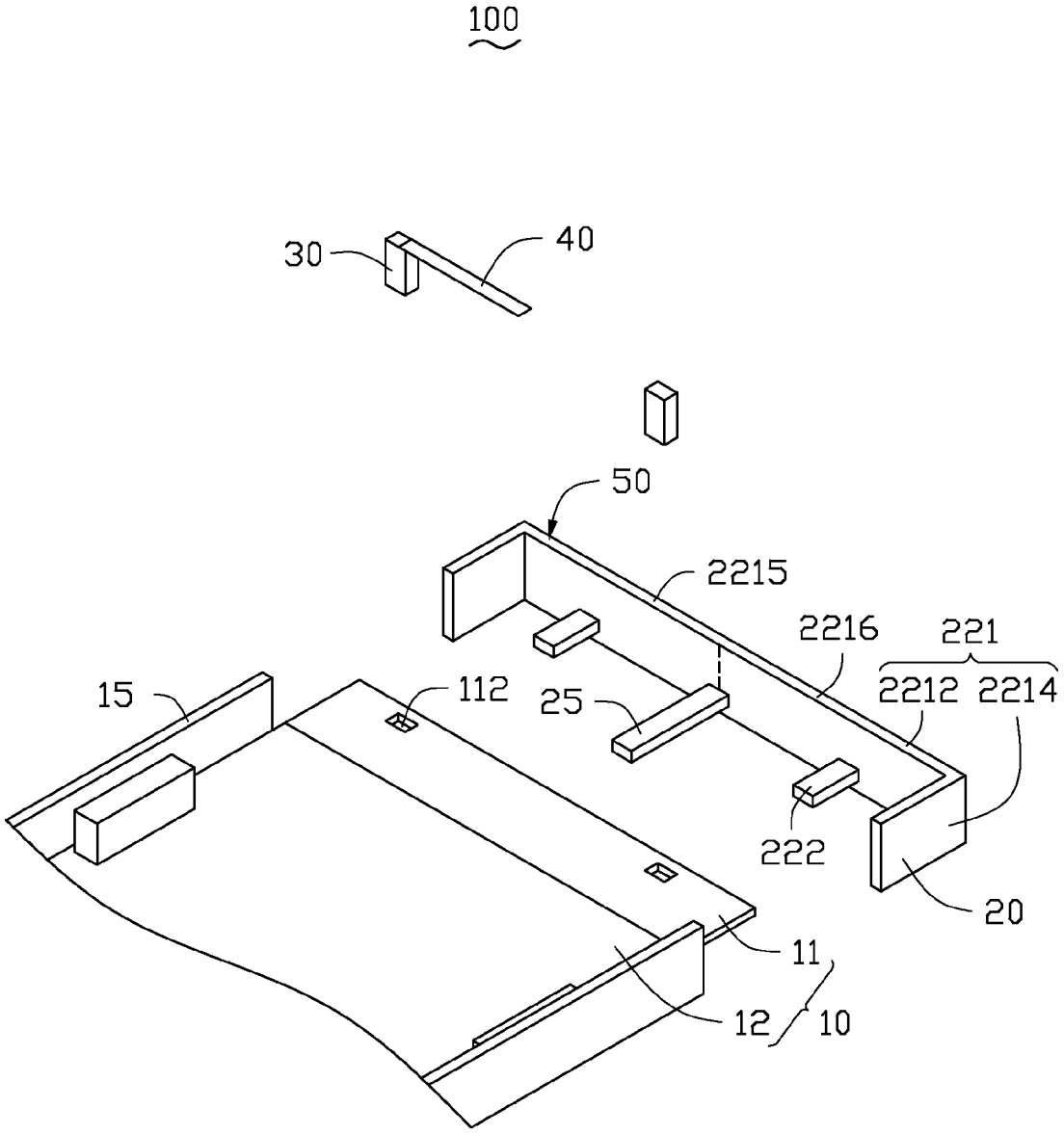
FIG. 2 is a schematic, exploded view of the antenna assembly of FIG. 1

FIG. 1 and FIG. 2 illustrate an antenna assembly 50 used in a wireless communication device 100, which can be a mobile phone or a personal digital assistant, for example (details not shown).

The wireless communication device 100 further includes a printed circuit board (PCB) 10 and a housing 15 surrounding the PCB 10.

The PCB 10 includes a carrying zone 11 and a grounding zone 12. The carrying zone 11 is used to attach the antenna assembly 50 and includes at least one fixing hole 112 defined in one end of the carrying zone 11. In the exemplary embodiment, the number of the at least one fixing hole 112 is two, and one of the two fixing holes 112 is used to establish an interconnection between the antenna assembly 50 and the printed circuit board 10 to feed current to the antenna assembly 50 from the printed circuit board 10. The grounding zone 12 is used to ground the antenna assembly 50.

The antenna assembly 50 includes a first antenna 20, an adjusting member 25, at least one connecting member 30, and a second antenna 40. The first antenna 20 is a part of the housing 15 of the wireless communication device 100. The first antenna 20 and other portions of the housing 15 are spaced from each other and cooperatively form an outside frame of the wireless communication device 100. The first antenna 20 is made of conductive materials, such as metal. The first antenna 20 includes a radiator 221 and at least one connecting portion 222. The radiator 221 is a substantially U-shaped frame and is matched with a boundary of the printed circuit board 10 to surround the printed circuit board 10. In the exemplary embodiment, the radiator 221 includes a bottom wall 2212 and two side walls 2214 set at two opposite sides of the bottom wall 2212, and the two side walls 2214 are spaced from the housing 15. The number of the at least one connecting portion 222 is two, the two connecting portions 222 extend from one side of the bottom wall 2212 and are spaced from each other. When the first antenna 20 is assembled to surround the PCB 10, the at least one connecting portion 222 is positioned below the carrying zone 11 and corresponds to the at least one fixing hole 112, respectively.

The adjusting member 25 is made of conductive materials, such as metal. A first end of the adjusting member 25 is set on the radiator 221 and is positioned between the two connecting portions 222, thereby dividing the radiator 221 into a first radiating portion 2215 and a second radiating portion 2216. A second end of the adjusting member 25 is connected to the grounding zone 12. During the design period, the adjusting member 25 can slide relative to the first antenna 20 to change a contact position between the radiator 221 and the grounding zone 12. Thus, the resonance wavelength required by the first antenna 20 can be adjusted to balance the central frequencies of the wireless signal received/sent by the first antenna 20.

The at least one connecting member 30 can be metal pieces, such as bolts or screws. The at least one connecting member 30 and the at least one fixing hole 112 cooperatively fix the antenna assembly 50 to the printed circuit board 10. In one exemplary embodiment, the number of the at least one connecting member 30 is two. When the two connecting members 30 are assembled on the PCB 10, each of the two connecting members 30 passes through each of the two corresponding fixing holes 112 to connect to each of the corresponding two connecting portions 222, thereby allowing one connecting member 30 to feed current to the antenna assembly 50.

The second antenna 40 is a monopole antenna. A first side of the second antenna 40 is fixed to one of the two connecting members 30, and a second side of the second antenna 40 extends parallel to the bottom wall 2212.

In assemble, the first antenna 20 surrounds the PCB 10, and the at least one connecting portion 222 is positioned below the PCB 10. One end of the adjusting member 25 is set on the radiator 221, the other end of the adjusting member 25 is connected to the grounding zone 12 of the PCB 10. The second antenna 40 is fixed to one of the two connecting members 30 and extends towards the other connecting member 30. The at least one connecting member 30 passes through the at least one fixing hole 112 and is connected to the at least one connecting portion 222, thereby fixing the first antenna 20 to the PCB 10.

Figure 3:
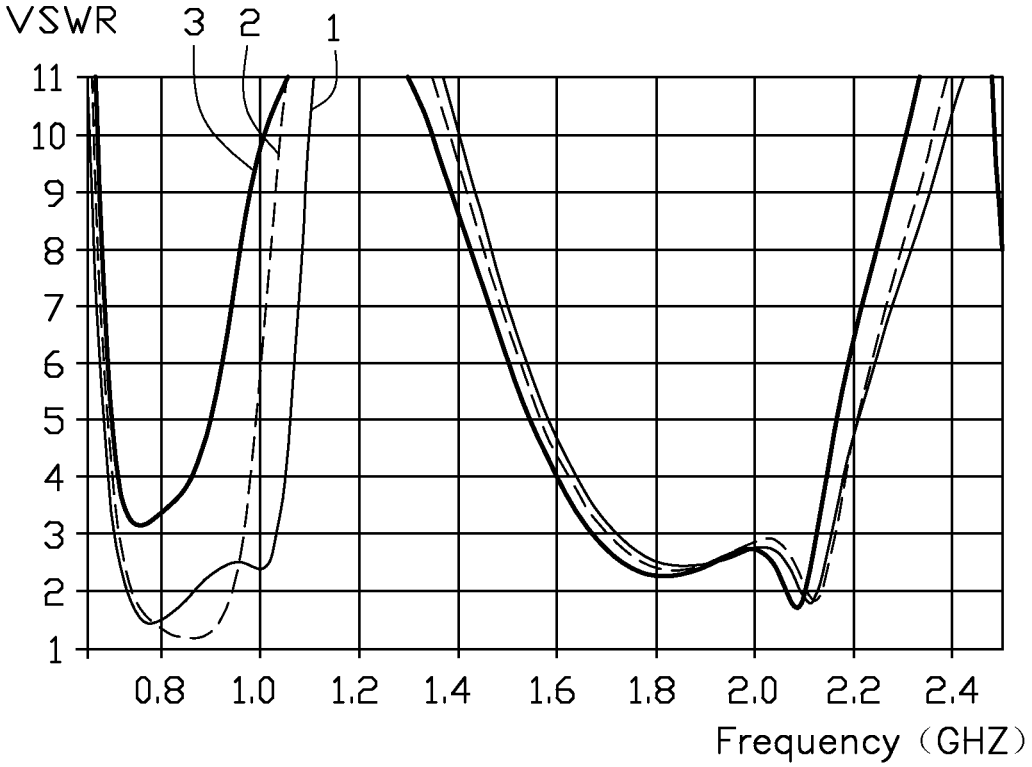
FIG. 3 is a Voltage Standing Wave Ratio (VSWR) graph of the antenna assembly of FIG. 2

When current is input to the antenna assembly 50 via the at least one connecting member 30, a first portion of the current flows to the at least one connecting member 30 and the second antenna 40, a second portion of the current flows to the first radiating portion 2215 and the adjusting member 25, and is grounded via the grounding zone 12. The antenna assembly 50 is activated to receive and transmit wireless signals at a first bandwidth, which can be for example about 1710 MHZ-2170 MHZ. Additionally, a third portion of the current flows to the first radiating portion 2215, the second radiating portion 2216 and the adjusting member 25, and is grounded via the grounding zone 12. The antenna assembly 50 is activated to receive and transmit wireless signals at a second bandwidth, which can be for example about 698 MHZ-960 MHZ. During the design period, the adjusting member 25 can slide relative to the first antenna 20 to change a length of the current flow of the radiator 221 for adjusting the bandwidth of the antenna assembly 50. FIG. 3 illustrates a VSWR graph of the antenna assembly 50 of FIG. 2. A curve 2 represents a VSWR curve of the antenna assembly 50 without sliding the adjusting member 35. A curve 1 and a curve 3 represent VSWR curves of the antenna assembly 50 when the adjusting member moves left or right. The antenna assembly 50 has a wide bandwidth when the adjusting member 25 slides relative to the radiator 221.

In summary, the at least one connecting member 30 connects the antenna assembly 50 to the PCB 10, thereby improving the structural strength of the wireless communication device 100 and saving the design cost. In addition, the adjusting member 25 connects the antenna assembly 50 to the grounding zone 12 of the PCB 10 to reduce the influence of low frequency efficiency, thereby allowing the wireless communication device 100 to have good radiating performance and to cover the low frequency spectrum of Long Term Evolution. Furthermore, the operating frequency band can be adjusted by sliding the adjusting member 25 relative to the radiator 221 for enhancing the flexibility of the wireless communication device 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna assembly, used in a wireless communication device including a housing, comprising:

a first antenna comprising a radiator and at least one connecting portion connected to the radiator, the radiator being a part of the housing of the wireless communication device;

a second antenna; and at least one connecting member connected to the at least one connecting portion to fix the first antenna to the wireless communication device and feed current to the first antenna and the second antenna.

2. The antenna assembly as claimed in claim 1, wherein the number of the at least one connecting member is two, the two connecting members are parallelly positioned on the radiator, the number of the connecting members is two, the two connecting members are respectively connected to the two connecting portions.

3. The antenna assembly as claimed in claim 1, further comprising an adjusting member, wherein a first end of the adjusting member is connected to the radiator to divide the radiator into a first radiating portion and a second radiating portion, a second end of the adjusting member is connected to the ground.

4. A wireless communication device, comprising:

a housing;

a printed circuit board; and an antenna assembly comprising:

a first antenna comprising a radiator and at least one connecting portion connected to the radiator, the radiator being a part of the housing;

a second antenna; and at least one connecting member connected to the at least one connecting portion to fix the first antenna to the printed circuit board and feed current to the first antenna and the second antenna from the printed circuit board.

5. The wireless communication device as claimed in claim 4, wherein the antenna assembly further comprises a adjusting member, and a first end of the adjusting member is connected to the radiator to divide the radiator into a first radiating portion and a second radiating portion, a second end of the adjusting member is connected to the ground.

6. The wireless communication device as claimed in claim 5, wherein the printed circuit board comprises a grounding zone, the adjusting member is positioned below the grounding zone and is connected to the grounding zone.

7. The wireless communication device as claimed in claim 5, wherein the housing and the first antenna cooperatively form an outside frame of the wireless communication device, and surround outside of the printed circuit board.

8. The wireless communication device as claimed in claim 7, wherein the radiator comprises a bottom wall and two side walls set at two opposite sides of the bottom wall, and the two sidewalls are spaced from the housing.

9. The wireless communication device as claimed in claim 4, wherein the printed circuit board further comprises a carrying zone, and the carrying zone defines at least one fixing hole, the number of at least one fixing hole is two, the number of at least one portion is two, the number of at least one connecting member is two, the two connecting portions are positioned below the carrying zone and each of the two connecting members passes through each of the two fixing holes to connect to each of the two connecting portions.

10. The wireless communication device as claimed in claim 9, wherein one of the two fixing holes is used to establish an interconnection between the antenna assembly and the printed circuit board to feed current to the antenna assembly from the printed circuit board.

* * * * *